US007776451B2

(12) United States Patent
Jiang et al.

(10) Patent No.: US 7,776,451 B2
(45) Date of Patent: Aug. 17, 2010

(54) COMPOSITE OVERLAY COMPOUND

(75) Inventors: Xiangyang Jiang, Dunlap, IL (US); M. Brad Beardsley, Laura, IL (US); D. Trent Weaver, Peoria, IL (US); Mark Steven Diekevers, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 462 days.

(21) Appl. No.: 11/878,583

(22) Filed: Jul. 25, 2007

(65) Prior Publication Data

US 2007/0267390 A1 Nov. 22, 2007

Related U.S. Application Data

(62) Division of application No. 11/041,950, filed on Jan. 26, 2005, now Pat. No. 7,345,255.

(51) Int. Cl.
*B32B 9/00* (2006.01)

(52) U.S. Cl. ..... 428/627; 428/457; 428/698; 428/704

(58) Field of Classification Search ..... 428/627, 428/411.1, 457, 688, 689, 698, 699, 704
See application file for complete search history.

(56) References Cited

U.S. PATENT DOCUMENTS 3,575,433 A 4/1971 Beyer et al.
3,743,556 A 7/1973 Breton et al.
4,005,914 A 2/1977 Newman
4,331,339 A 5/1982 Reinsma
4,335,924 A 6/1982 McCloskey
4,615,734 A * 10/1986 Spriggs ..... 75/237
4,666,318 A 5/1987 Harrison
4,741,974 A 5/1988 Longo et al.
4,814,234 A 3/1989 Bird
4,819,999 A 4/1989 Livesay et al.
5,038,640 A 8/1991 Sullivan et al.
5,126,104 A 6/1992 Anand et al.
5,141,574 A 8/1992 Takahashi et al.
5,194,237 A * 3/1993 Cliche et al. ..... 423/440
5,328,763 A 7/1994 Terry
5,707,694 A 1/1998 Beardsley et al.
5,736,200 A 4/1998 Beardsley et al.
5,826,884 A 10/1998 Anderton et al.

(Continued)

FOREIGN PATENT DOCUMENTS

EP 0 834 585 4/1998

(Continued)

*Primary Examiner*—Timothy M Speer
(74) *Attorney, Agent, or Firm*—Finnegan, Henderson, Farabow, Garrett & Dunner LLC

(57) ABSTRACT

A method of forming a composite overlay compound on a substrate includes forming a mixture including at least one component from a first group of component materials including titanium, chrome, tungsten, vanadium, niobium, and molybdenum. The mixture also includes at least one component from a second group of component materials including carbon and boron, and the mixture further includes at least one component from a third group of component materials including silicon, nickel, and manganese. The mixture of selected component materials is then applied to a substrate material to form an overlay compound on the substrate material. The overlay compound is fused to the substrate to form a metallurgical bond between the substrate material and the overlay compound.

14 Claims, 7 Drawing Sheets

U.S. PATENT DOCUMENTS

| | | | | |
|---|---|---|---|---|
| 5,841,033 | A | | 11/1998 | Burris et al. |
| 5,966,585 | A | | 10/1999 | Sue |
| 5,981,081 | A | * | 11/1999 | Sue ..... 428/564 |
| 5,994,664 | A | | 11/1999 | Anderton et al. |
| 6,004,372 | A | | 12/1999 | Quets |
| 6,045,200 | A | | 4/2000 | Anderton et al. |
| 6,048,586 | A | | 4/2000 | Burris et al. |
| 6,074,022 | A | | 6/2000 | Anderton et al. |
| 6,089,683 | A | | 7/2000 | Anderton et al. |
| 6,102,408 | A | | 8/2000 | Anderton et al. |
| 6,105,969 | A | | 8/2000 | Anderton et al. |
| 6,142,247 | A | | 11/2000 | Pessier |
| 6,145,941 | A | | 11/2000 | Anderton et al. |
| 6,309,762 | B1 | | 10/2001 | Speckert |
| 6,414,258 | B1 | | 7/2002 | Amano |
| 6,562,480 | B1 | | 5/2003 | Stong et al. |
| 6,634,725 | B2 | | 10/2003 | Sugiyama et al. |
| 6,649,682 | B1 | | 11/2003 | Breton et al. |
| 2002/0157873 | A1 | | 10/2002 | Crowe et al. |
| 2002/0192494 | A1 | * | 12/2002 | Tzatzov et al. ..... 428/655 |
| 2003/0168912 | A1 | | 9/2003 | Wodrich et al. |
| 2003/0205944 | A1 | | 11/2003 | Adams et al. |

FOREIGN PATENT DOCUMENTS

| | | |
|---|---|---|
| GB | 933 406 | 8/1963 |
| GB | 1 139 522 | 1/1969 |

* cited by examiner

COMPOSITE OVERLAY COMPOUND

This application is a divisional of application Ser. No. 11/041,950, filed Jan. 26, 2005, now pending, which is incorporated herein by reference in its entirety.

TECHNICAL FIELD

This disclosure is directed toward a composite overlay compound and, more particularly, toward a composite overlay compound on a substrate.

BACKGROUND

Track link assemblies for track-type construction equipment generally include a number of track bushings and entrained track links, driven by a sprocket. One of the main causes of damage to the track bushings is wear, such as abrasive or sliding wear. Wear may result from the harsh, contaminated environments in which the track assembly operates. For example, during operation, the bushings may be exposed to debris, soil, rocks, sand and other abrasive materials. These materials may accumulate between the engaging surfaces of the track bushing and the drive sprocket teeth, directly grinding, wearing, pitting, scratching, and/or cracking the surface of the track bushing and sprocket. As the sprocket continues to drive the track, the wear may degrade the outer diameter of the bushings and sprocket profile, limiting the life of the track link system.

Typical track bushings may be formed from materials that are hardened to decrease wear and increase service life. For example, typical track bushings may be case hardened by carburizing the bushing material. However, these materials and methods may still result in a relatively short service life.

One method for extending the life of a track bushing includes bonding a coating to the exterior of the track bushing. One example of this method is disclosed in U.S. Patent Publication No. US 2003/0168912 to Wodrich et al. The '912 publication discloses a track pin bushing having a metallurgically bonded coating disposed about its circumference. The coating is formed of a fused alloy that contains little or no inclusions. The alloy is formed first by generating a slurry of polyvinyl alcohol and a finely divided powder. Then, the slurry is applied to a bushing, dried, and fused to form the coating. However, the coating described in the '912 publication may not provide a level of wear resistance to a bushing that may be obtained using alternate methods. Accordingly, wear surfaces on components of endless tracks, such as track bushings, that provide acceptable wear resistance are desired to reduce the long-term maintenance cost associated with endless tracks.

The material and processes disclosed herein are configured to overcome one or more of the deficiencies in the prior art.

SUMMARY OF THE INVENTION

In one exemplary aspect, a method of forming a composite overlay compound on a substrate is disclosed. The method may include forming a mixture including at least one component from a first group of component materials including titanium, chrome, tungsten, vanadium, niobium, and molybdenum. The mixture also may include at least one component from a second group of component materials including carbon and boron, and the mixture further may include at least one component from a third group of component materials including silicon, nickel, and manganese. The mixture of selected component materials then may be applied to a substrate material to form an overlay compound on the substrate material. The overlay compound may be fused to the substrate to form a metallurgical bond between the substrate material and the overlay compound.

In another exemplary aspect, a composite overlay compound and substrate is disclosed. The material may include a matrix including at least one component from a first group of component materials including titanium, chrome, tungsten, vanadium, niobium, and molybdenum. The matrix also may include at least one component from a second group of component materials including silicon, nickel, and manganese. Hard-particles may be provided in the matrix, the hard-particles may include at least one of carbide and boride. The material also may include a substrate material, with the matrix being fused to the substrate material with a metallurgical bond.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
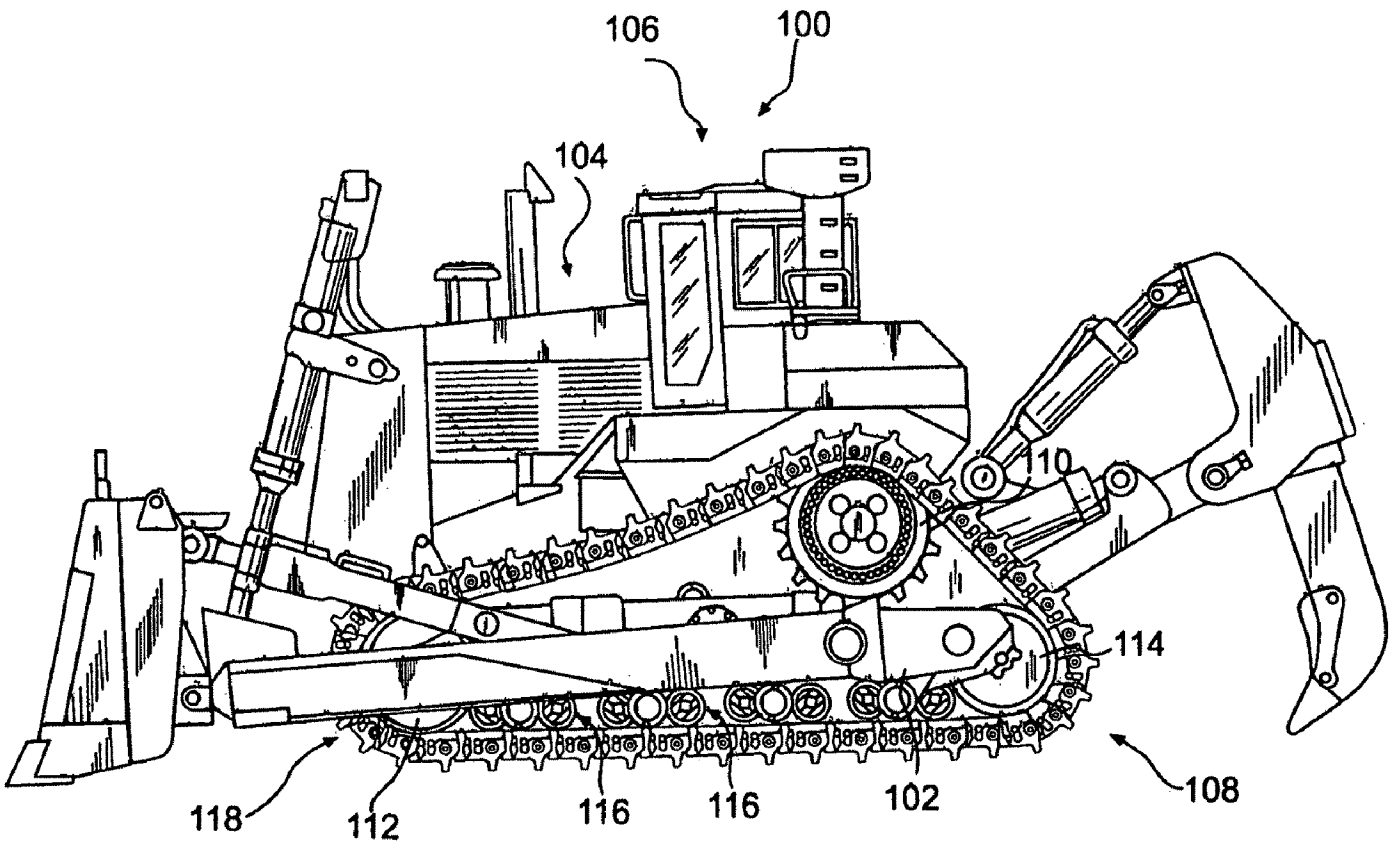
FIG. 1 is a pictorial illustration of an exemplary work machine.

Referring now to FIG. 1 there is shown a work machine 100 including a frame 102, an engine assembly 104, a cab assembly 106, and an undercarriage assembly 108. The engine assembly 104 and cab assembly 106 are mounted on the frame 102, while the undercarriage assembly 108 is mechanically coupled to frame 102.

The undercarriage assembly 108 includes a drive sprocket 110, a pair of idler wheels 112, 114, a number of roller assemblies 116, and a track chain assembly 118. During use, the drive sprocket 110 rotates and engages the track chain assembly 118, thereby causing the track chain assembly 118 to rotate around a path defined by the drive sprocket 110 and the idler wheels 112, 114. The rotation of the track chain assembly 118 causes the work machine 100 to be propelled over the ground so as to perform various work functions.

Figure 2:
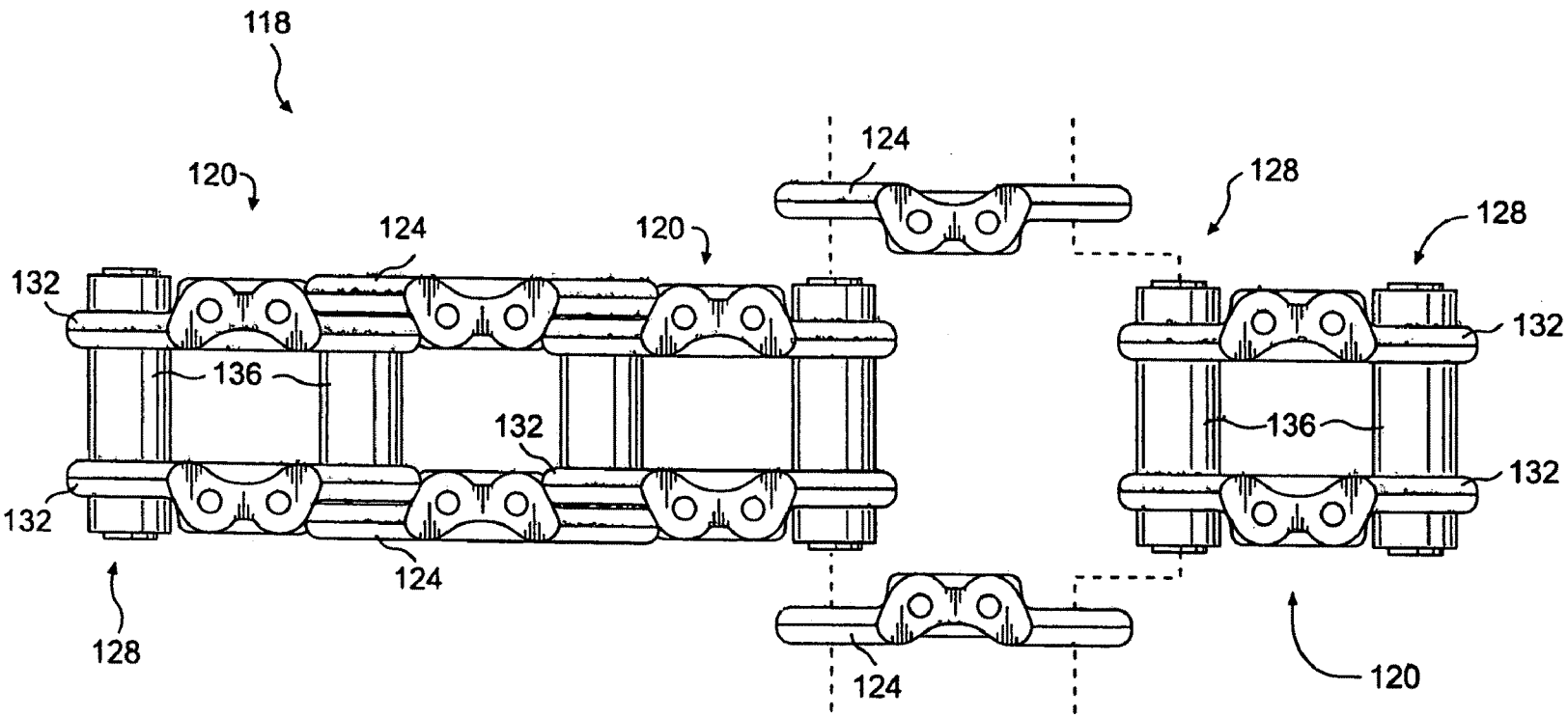
FIG. 2 is a pictorial illustration of an exemplary track assembly of the work machine in FIG. 1.

As shown more clearly in FIG. 2, the track chain assembly 118 includes a number of subassemblies 120. Each subassembly 120 is mechanically coupled to an adjacent subassembly 120 by outer links 124 in a manner to form a closed loop. Each subassembly 20 includes a cartridge assembly 128 and inner links 132.

Figure 3:
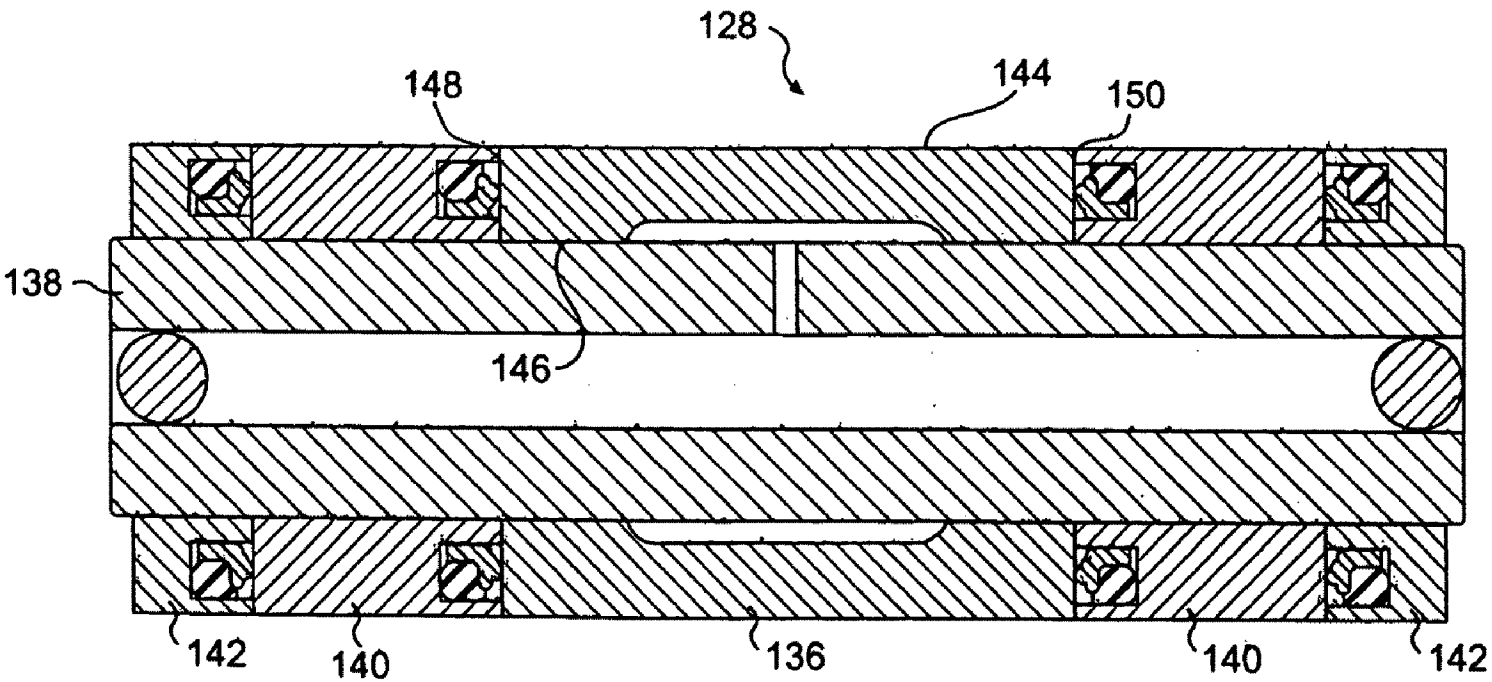
FIG. 3 is a cross-sectional illustration of an exemplary cartridge assembly of the track assembly of FIG. 2.

As shown in FIG. 3, the cartridge assembly 128 includes a bushing 136, a track pin 138, an insert 140, and a collar 142. The bushing 136 is configured on the track chain assembly 118 to contact and be driven by the drive sprocket 110. Accordingly, the bushing 136 is configured to withstand high pressure and force that may be applied by the drive sprocket 110 so that the track chain assembly 118 may be driven as desired by an operator.

The bushing 136 may be disposed generally concentrically with the track pin 138 and may include an exterior surface 144, an interior surface 146, and first and second ends 148, 150. The bushing 136 may be formed of a wear-resistant material including a substrate material and a composite overlay compound, with the composite overlay compound forming at least a portion of the exterior surface 144.

Figure 4:
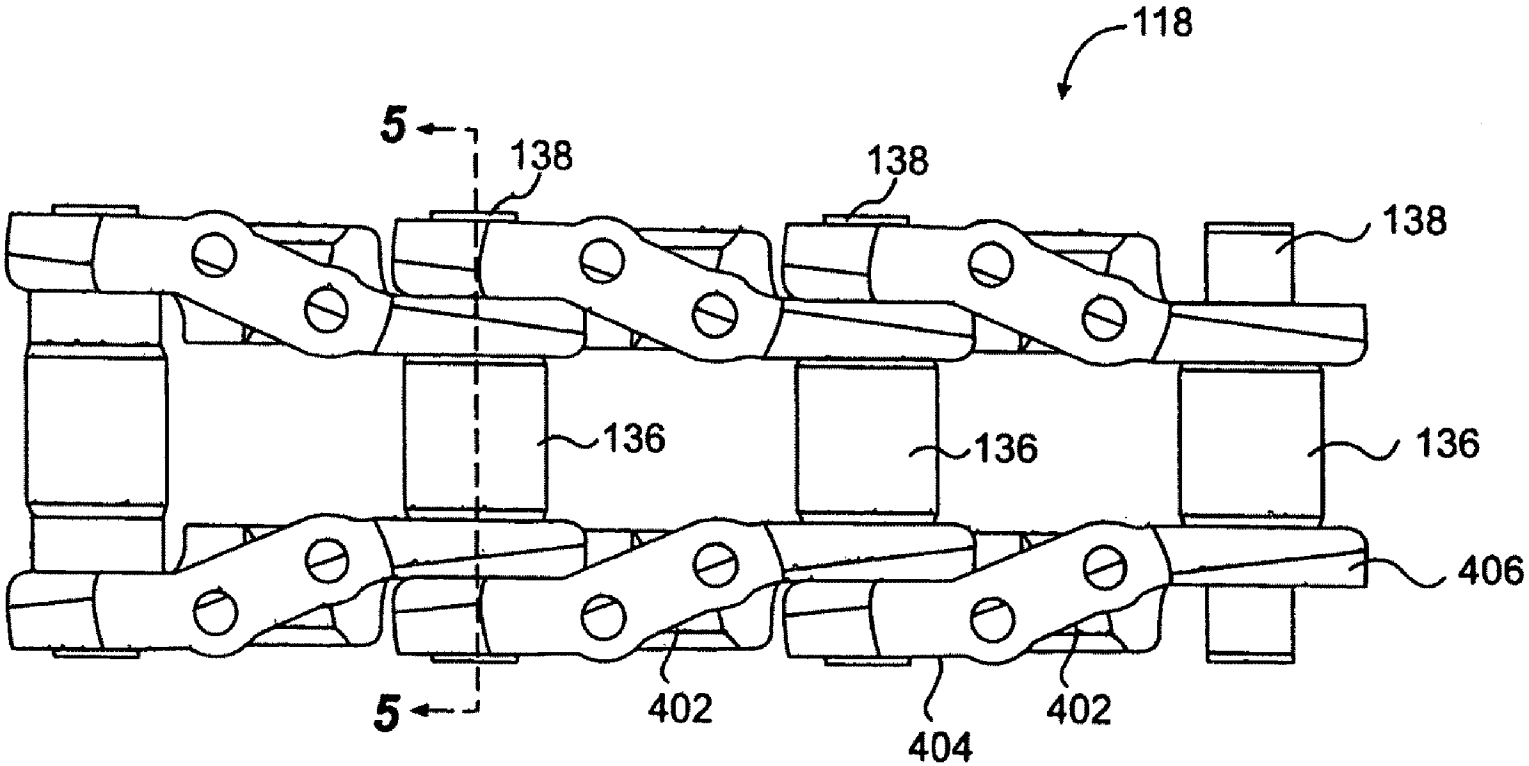
FIG. 4 is a pictorial illustration of another exemplary track assembly for a work machine.
Figure 5:
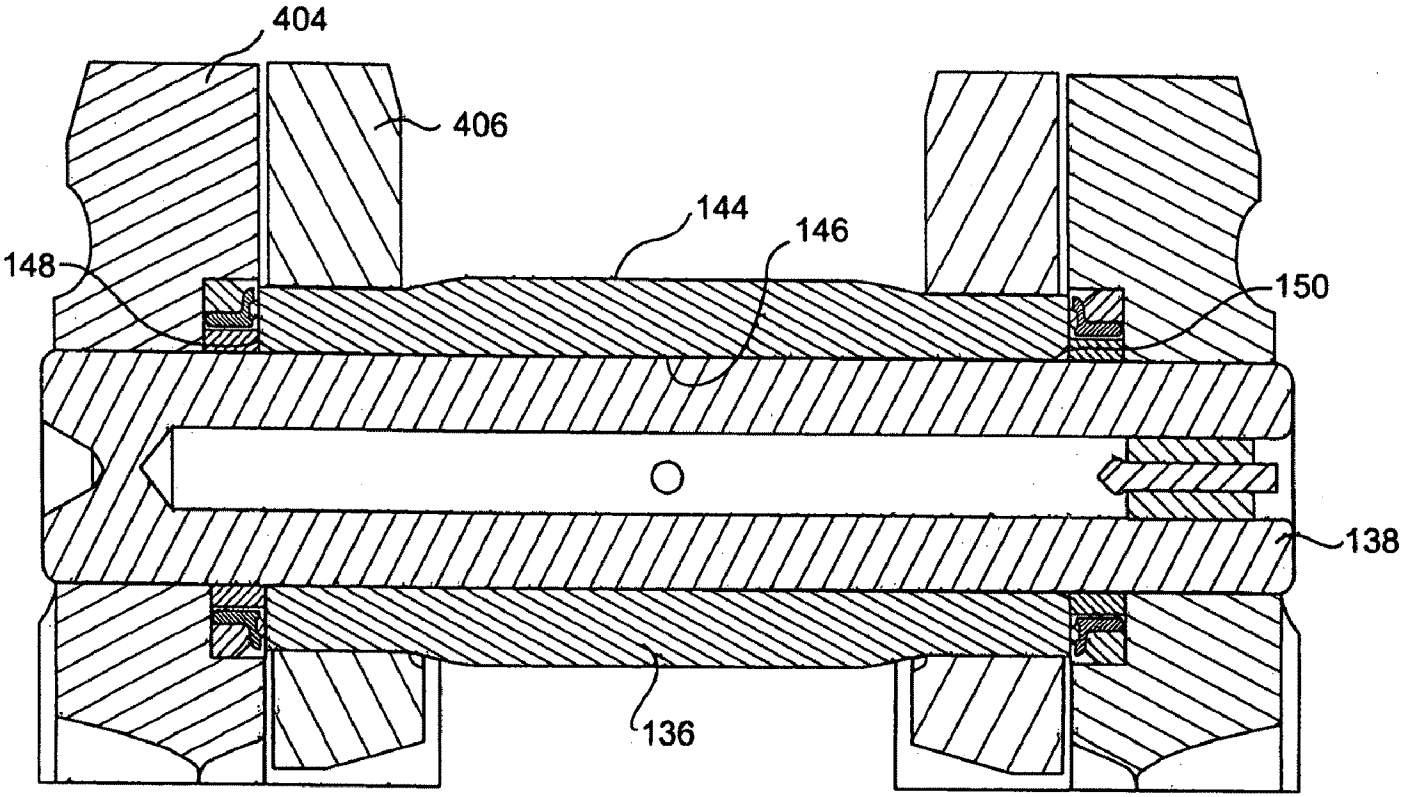
FIG. 5 is a cross-sectional illustration of an exemplary subassembly of the track assembly of FIG. 4.

FIGS. 4 and 5 show an alternative track link assembly 118. FIG. 5 is a cross-sectional view taken along the line 5-5 in FIG. 4. Like the exemplary track link assembly 118 shown in FIGS. 2 and 3, the track link assembly 118 in FIGS. 4 and 5 includes a bushing 136 and a track pin 138 connected by track links 402 to an adjacent bushing 136 and pin 138. In this embodiment, the track links 402 are offset-type track links having a first outer end 404 and a second inner end 406. With reference to FIG. 5, the second inner end 406 is connected to the bushing 136 and the first outer end 404 is connected to the track pin 138. As explained above, the bushing 136 may include an exterior surface 144, an interior surface 146, and first and second ends 148, 150. The bushing 136 may be formed of a wear-resistant material including a substrate material and a composite overlay compound, with the composite overlay compound forming at least a portion of the exterior surface 144.

The composite overlay compound may be formed of hard-particles dispersed in an iron-based, relatively softer matrix, thereby providing a relatively high resistance to wear and at least a moderate impact resistance. In one exemplary embodiment, the particles are substantially uniformly dispersed in the matrix. Further, the composite overlay compound may be fused to the substrate material with a metallurgical bond so that the composite overlay compound does not easily chip or spall from the substrate. In one exemplary embodiment, the thickness of the composite overlay compound may be greater than about 0.5 millimeters, and in one exemplary embodiment, the thickness may be between about 0.5 and 4 millimeters, providing a thick, wear-resistant surface. It should be noted that the overlay compound may have a thickness greater than or smaller than those mentioned.

Exemplary methods of making the wear-resistant material disclosed herein, with its substrate and composite overlay compound, are provided. The wear-resistant material may be formed, for example, through a direct synthesis method, a hard-particle additive method, a brazing method, or any other suitable method or process.

The direct synthesis method forms the composite overlay compound of the wear-resistant material using direct synthesis by reaction and precipitation. This method includes synthesizing the hard-particles and the matrix in place. As used herein, synthesizing is meant to include forming a compound using desired elements, and precipitating is meant to include forming particles from the compound. The direct synthesis method may include forming a mixture of a selected first material, a second material, a third material, and so on. These materials may be selected to provide a chemistry that allows formation of carbides and borides, through synthesis and precipitation, in a desired form and quantity. In addition, these materials may be selected to form the matrix with the desired chemistry and structure. It should be noted that the material components may be individually selected, or alternatively, may be provided in a pre-mixed form, such as in a steel powder form, that may be used to form the composite overlay compound.

In some exemplary embodiments, carbide and/or boride may synthesize from elements in the composite material. Some examples of elements that may be used in the synthesis of the carbide and/or boride are titanium, chrome, and vanadium. However, other materials may also be used.

In one exemplary embodiment, the composite overlay compound may be formed of at least one component taken from each of at least three groups of materials. For example, the composite material may include at least one component from a first group including titanium, chrome, tungsten, vanadium, niobium, and molybdenum; at least one component from a second group including carbon and boron; and at least one component from a third group including silicon, nickel, and manganese. Iron may also be included, and in one exemplary embodiment, may form a substantial portion of the balance of the composite material.

In one exemplary embodiment, the composite overlay compound includes between 5 and 50 wt % of at least one element from the group of titanium, chrome, molybdenum, and a combination thereof. The composite material may also include between 3 and 10 wt % of at least one element from a group of carbon, boron, and a combination thereof, and may also include up to 20 wt % of at least one element from a group of silicon, nickel, manganese, and combinations thereof Further, the composite material may include up to 10 wt % of at least one element from a group of vanadium, niobium, tungsten, and a combination thereof.

In one exemplary embodiment, the first, second, and third materials may be homogenously mixed to form a mixture that may be melted before, during, or after application onto the substrate material. One or more carbides and/or borides may synthesize and precipitate from the melt, and a steel matrix may form. This type of composite overlay compound may be made, for example, by a plasma transfer arc (PTA) process and by a cored wire welding process, among others. In one exemplary embodiment, material types may include steel-TiC, steel/or Ni alloy-FeMoB, steel-TiB, steel-CrFeC, among others.

Several examples of forming the composite overlay compound using the direct synthesis method are described below.

Example 1

In one exemplary embodiment, the composite overlay compound may include a titanium containing powder, such as eutectic ferrotitanium powder (Fe-70Ti), that may be mixed with other alloy powders to form a mixture with a composition of Ti: 12 wt %; C: 4 wt %; Cr: 7.3 wt %; Ni: 1 wt %; Mo: 1.2 wt %; Si: 1 wt %; and Mn: 1.2 wt %, with any remaining weight percentage being substantially iron. Carbon may be introduced into the system using any carbon containing powder, such as a cast iron powder and/or a high carbon chrome powder. It should be noted that the carbon may be introduced using other carbon-containing powders, such as, Ni-graphite powder, graphite/carbon black powder, high carbon ferrochrome, and others. The ferrotitanium and carbon-containing mixture may be fed into a PTA torch, melted to synthesize and precipitate carbide components, and applied onto a steel substrate material as a composite overlay compound. In one exemplary embodiment, the steel substrate material is the bushing 136 for the track chain assembly 118, as shown in FIGS. 2 and 3. The composite overlay compound may be formed on the exterior surface 144 of the bushing 136 on an area configured to directly contact the drive sprocket 110.

The synthesized overlay compound may contain fine titanium carbide (1 to 10 um, for example) dispersed in a manganese, molybdenum, chrome, and/or silicon containing steel matrix, which may be fused to the substrate material to form a metallurgical bond. The titanium content in the starting mixture may be between 8 and 40 wt % and the starting content of the carbon containing powder may be between 60-92 wt %.

In a bench test (bushing/sprocket test), the wear-resistant material with the composite overlay compound showed a four to five fold improvement in wear-resistance over typical carburized parts, while the sprocket wear rate also was reduced. It should be noted that the weight percentage range for the materials in this example may be, for example, Ti: 8-40 wt %; C: 1-10%; Cr: up to 40%; Ni: up to 15%, Mn: up to 10%; Mo: up to 8%; and Si: up to 4%. In addition, the composite overlay compound may contain vanadium, niobium, tungsten, or combinations of these elements, among others, up to 10 wt %.

In this example, after synthesizing, the composite overlay compound may have a hardness in the range of HRC 40-56 in an as-welded state. Through heat treating (quenching and tempering) however, the hardness may be increased. For example, the hardness may be increased within a range of HRC 55-59.

Figure 6:
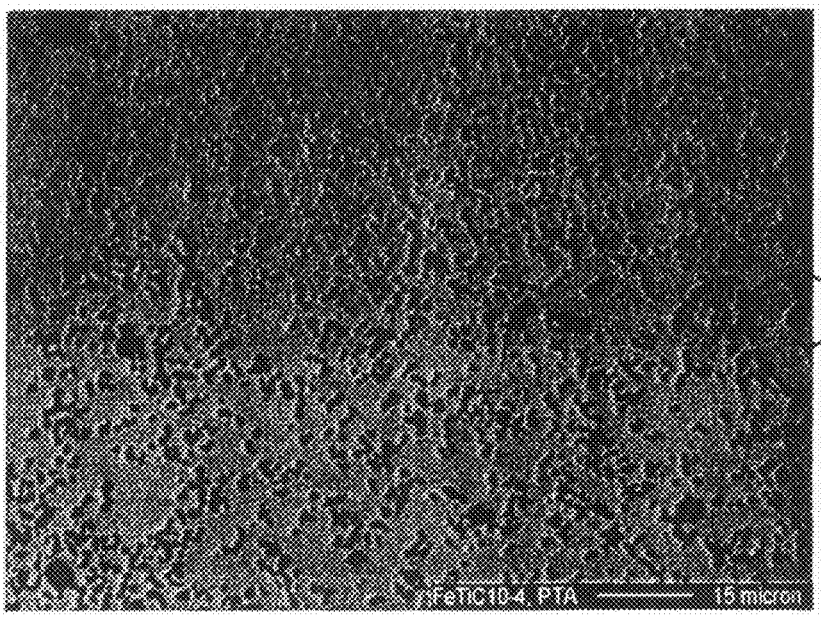
FIG. 6 is a scanning electronic microscope (SEM) micrograph illustrating representative microstructure consistent with an exemplary embodiment of the invention.

FIG. 6, for example, is a SEM micrograph illustrating representative microstructure consistent with the exemplary embodiment of the overlay compound described above. FIG. 6 includes TiC particles 600 and the steel matrix 602. As shown, the TiC-steel mixture is provided as a substantially uniformly distributed microstructure with the TiC being synthesized during the process of melting the mixture to form the composite overlay compound.

Example 2

In a second exemplary embodiment, the precursor material for the composite overlay compound may include a ferrotitanium powder. The ferrotitanium powder may be carburized before being mixed with other component material powders and synthesized into a carbide powder. This may be accomplished, for example, by mixing the ferrotitanium powder with a carbon-containing powder such as graphite or carbon black, for example, and also mixing with, for example, at least one component from a first group including titanium, chrome, tungsten, vanadium, niobium, and molybdenum; at least one component from a second group including carbon and boron; and at least one component from a third group including silicon, nickel, and manganese. The mixed powders then may be heated to a temperature between about 800 and 1300 degrees Celsius for an extended period of time.

In another example, the ferrotitanium powder may be carburized by mixing with a gaseous carbon source such as endothermic carburizing gas known to those skilled in the art. The carburizing process may be controlled in such a way that titanium could be partially or completely carburized as needed. In one exemplary embodiment, the carburizing process may be controlled by the amount of carbon-containing material or total carbon content in the material. After carburization, the carburized ferrotitanium powder may be mixed with a carbon-containing powder, such as a cast iron powder for example, prior to being mixed with other components, including at least one component from each of the first, second, and third component groups. In another embodiment, the carburized ferrotitanium powder is mixed with carbon-containing FeMn, FeSi, FeMo, HC, FeCr, and Ni, among others. Once complete, the mixture may be applied to a steel substrate material, such as the bushing 136. A PTA processing method or other type of welding process may melt the mixture to synthesize and precipitate at least one of carbide and boride.

It should be noted that in yet another example, the ferrotitanium powder and the carbon-containing powder may be mixed before carburization. Then, after mixing, the mixture may undergo a carburizing process to produce a carburized, partially alloyed powder body for the PTA processing method. In one exemplary embodiment, the titanium content in the finished powder may be between 8 and 50 wt %. Although this example is described with reference to a ferrotitanium powder, a similar process may be used to boronize a powder to form a respective boride material. This may be done before or after mixing the selected component powders as described above.

Example 3

In a third exemplary embodiment, the composite overlay compound is formed of component materials described above, namely, at least one component from a first group including titanium, chrome, tungsten, vanadium, niobium, and molybdenum; at least one component from a second group including carbon and boron; and at least one component from a third group including silicon, nickel, and manganese. In this exemplary embodiment, a boron containing powder, such as ferroboron or nickel boron, may be mixed with a molybdenum containing powder, such as ferromoly or molybdenum, or alternatively, any of a titanium containing powder, chrome, nickel, iron, silicon, or silicon-containing powder and carbon-containing powder. In one example, a powder mixture for forming the overlay compound may include Mo: 24.5 wt %; Cr: 18 wt %; Ni: 2 wt %; B: 5.4 wt %; and C: 0.2 wt %, with the remainder being substantially iron. This mixture may then be fed into a PTA torch, melted to synthesize and precipitate boride components, and applied to the exterior of a steel substrate material, such as the bushing 136, to form the composite overlay compound. In this exemplary embodiment, the hard-particles in the composite overlay compound are complex borides of iron, molybdenum, and/or chrome. The matrix about the hard-particles may be boron-containing steel or a nickel based alloy.

In this exemplary embodiment, the boron content is between 2% and 10 wt %, molybdenum content may be as high as 50 wt %, chrome content may be as high as 55 wt %, and titanium content may be as high as 50 wt %. In a bench test, a track bushing 136 with this type of wear-resistant material showed a five to six fold improvement over a carburized bushing, and in addition, by reducing the friction between the bushing 136 and the sprocket 110, the sprocket wear was reduced by 50%.

In this embodiment, the mixture for forming the composite overlay compound may include materials in the ranges of Ti: 0-40 wt %; Cr: 0-50 wt %; Mo: 0-50 wt %; Ni: 0-30 wt %; Si: 0-5 wt %; B: 1-8 wt %; and C: 0-4 wt %, with the remainder being substantially iron. The mixture may also include, among other things, vanadium, niobium, and tungsten, and mixtures thereof, for example, in amounts ranging up to 10 wt %.

Figure 7:
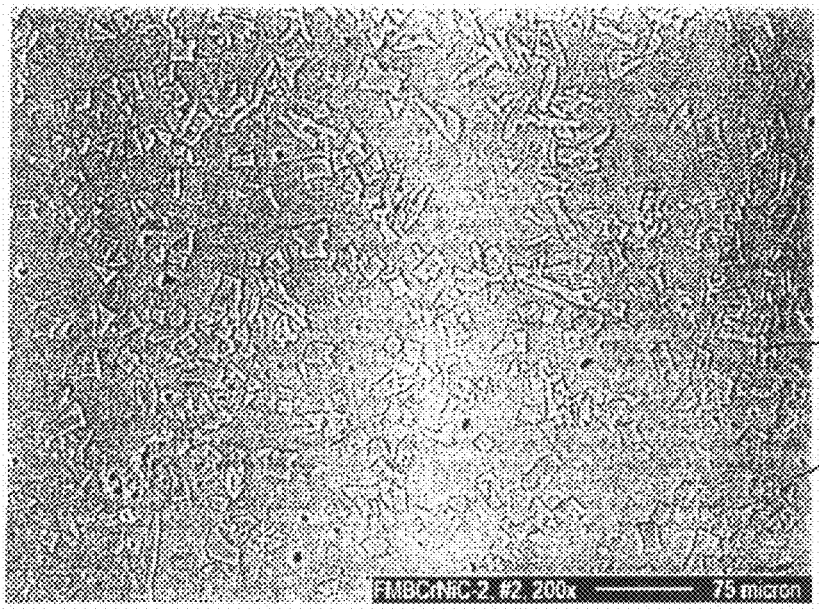
FIG. 7 is a SEM micrograph illustrating another representative microstructure consistent with an exemplary embodiment of the invention.

FIG. 7, for example, is a SEM micrograph illustrating representative microstructure consistent with the exemplary embodiment of the composite overlay compound described above in Example 3. As shown in FIG. 7, the FeMoBCrNi matrix 700 surrounds boride particles 702. In another exemplary embodiment, the mixture for forming the overlay compound of the matrix and hard particles may include materials in the ranges of Ti: 0-40 wt %; Cr: 0-50 wt %; Mo: 0-50 wt %; Ni: 0-10 wt %; Si: 0-10 wt %; Mn: 0-8 wt %; C: 0-10 wt %; and B: 0-10 wt %, with a substantial portion the balance being iron.

It should be noted that the composite overlay compound used in any of the examples described above, and in other examples, may be formulated in such a way that the form of the steel matrix can be austenitic, ferritic or martensitic. Accordingly, the formulation may be tailored to the application. In addition, the formulation may be tailored to provide a high chrome content in the matrix to offer a desired corrosion protection. In addition, it should be noted that after applying the composite overlay compound to the substrate to form the wear-resistant material, the wear-resistant material may be machined and may be heat treated to further increase the hardness and wear-resistance level.

Although the examples above are described as using a PTA or another type of welding process to synthesize and apply the composite overlay compound to the steel substrate material, the composite overlay compound may instead be applied using a thermal spray process, such as a plasma spray, flame spray, or an HVOF process to form the composite overlay compound on the substrate. Then, a high energy arc lamp, laser, induction, or flame, or even a furnace may be used to apply heat to fuse the composite overlay compound onto the substrate material with a metallurgical bond. The fusing processes may precipitate the carbide or boride while applying the mixture. In one exemplary embodiment, laser-assisted thermal spray or laser cladding may be used to form a dense composite overlay compound in single step processing.

As stated above, the composite material may be formed using processes other than the direct synthesis method. In one exemplary embodiment, the composite overlay compound may be formed using a hard-particle additive method. The hard-particle additive method may include forming a mixture having at least one component from a first group of component materials including titanium, chrome, tungsten, vanadium, niobium, and molybdenum; at least one component from a second group of component materials including carbide and boride; and at least one component from a third group of component materials including silicon, nickel, and manganese. The balance may be substantially iron.

In one exemplary embodiment, the mixture may be, for example, hard-particles added into the mixture described above in Example 1. For example, the hard-particles may be added into the overlay compound of Ti: 12 wt %; C: 4 wt %; Cr: 7.3 wt %; Ni: 1 wt %; Mo: 1.2 wt %; Si: 1 wt %; and Mn: 1.2 wt %, with a substantial portion of any remaining weight percentage being iron. In one exemplary embodiment, at least some of the elements described above may provided in a steel powder, that may be mixed with the hard-particles of carbides and borides. In one exemplary embodiment, the steel powder may include, for example, at least one of stainless steel, tool steel, carbon steel, a nickel base alloy, or the powders listed above in Examples 1-3. The carbides and borides may include, for example, at least one of titanium carbide, titanium boride, tungsten carbide, vanadium carbide, and tantalum carbide powders, among others. In one exemplary embodiment, the hard particles of carbide or boride are added to the mixture with a volume fraction in the range of 5-50%. Accordingly, after synthesizing, the resultant composite overlay may include the hard-particles added to the mixture, and in certain embodiments, may also include hard-particles synthesized and precipitated during processing.

Example 4

One example of adding hard-particles to form the composite overlay compound includes adding up to 40% volume fraction of coarse TiC particles, in powder mixture, to the mixture described in Example 1. During the application process, a bimodal TiC particle size distribution may form in the steel matrix, with the particles including both the added particles and the precipitated particles. Alternatively, TiC particles may be mixed with a commercially available material, such as a nickel-based material. One suitable commercially available material is a Deloro 60 (a Deloro Stellite material).

The prepared powders then may be mixed, melted, and applied as a composite overlay compound, in any suitable order, to the substrate material, such as a steel substrate of the bushing 136, through an application process, such as the PTA process. It should be noted that the application process could be any other application processes, including, for example, laser assisted thermal spray, laser cladding, a thermal spray process using plasma, flame spray, or HVOF process, thereby fusing the composite overlay material to the substrate with a metallurgical bond. In this embodiment, the added hard-particles may have a diameter within the range of about five to two hundred micrometers, or larger. When the hard-particles are introduced into a mixture that also provides for synthesizing and precipitating carbide or boride, bimodal particle size distribution may provide increased wear resistance. In bench tests, a bushing having such a composite overlay showed a four-fold improvement in track bushing wear resistance over typical carburized bushings.

Figure 8:
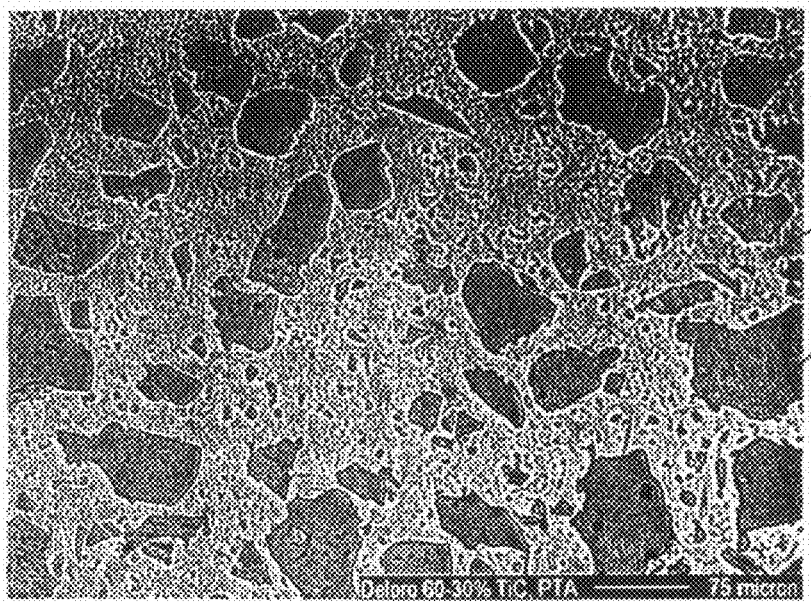
FIG. 8 is a SEM micrograph illustrating another representative microstructure consistent with an exemplary embodiment of the invention.

FIG. 8, for example, is a SEM micrograph illustrating representative microstructure of the overlay compound consistent with the exemplary embodiment described in Example 4. The micrograph of FIG. 8 includes a matrix 800 of 70 wt % Deloro 60 and particles 802 of 30 wt % TiC. As shown, the TiC is at least substantially uniformly distributed in the matrix of Deloro 60.

As stated above, the composite material may be formed using processes other than the direct synthesis method and the hard-particle additive method. In one exemplary embodiment, the overlay compound of the composite material may be formed using a brazing process or method. In one exemplary embodiment, the brazing process may include forming a brazing compound having at least one component from each of three groups of component materials with the first group including titanium, chrome, tungsten, vanadium, niobium, and molybdenum; the second group including carbon and boron; and the third group including silicon, nickel, and manganese. In this embodiment, the composite material may also include an overlay compound including a large volume fraction of hard-particles dispersed in a relatively tough matrix with strong bonding with the substrate material. The hard-particles may include tungsten carbide, titanium carbide, various chrome carbides including high carbon chrome, ferrochrome carbides (high carbon ferrochrome), titanium boride, vanadium carbide, and niobium carbide, among others. The matrix may be formed of a tough, hard, low melting point alloy such as, for example, Ni—Cr—B—Si or Fe—Cr—B—Si. These exemplary alloys are also known as self-fluxing alloys.

One brazing method for applying the composite overlay compound to the substrate material includes the use of prefabricated cloths, while another brazing method includes high energy beam assisted overlaying. Other brazing methods may also be used. The brazing method using a prefabricated cloth is described first.

Layers of prefabricated cloth containing the hard-particles and the matrix elements may be applied to the substrate to form a laminate. In one exemplary embodiment, a layer of prefabricated cloth containing hard-particles and polytetrafluoroethylene and a layer of prefabricated cloth containing matrix material and polytetrafluoroethylene are applied to the bushing 136, which acts as the substrate. The matrix material may be mixed, or alternatively, may include different elements that may be melt to form the matrix material of the composite overlay compound. The substrate is heated to above the solidus line temperature of the matrix alloy, thereby melting the matrix. The melted matrix bonds the hard-particles together within the matrix, thereby forming the overlay compound and, in addition, fusing the overlay compound and substrate with a metallurgical bond. In one exemplary embodiment, paints containing hard-particles and self-fluxing alloy particles may be applied to the substrate surface and heated to form the composite overlay compound.

In each embodiment, the brazing may be achieved using any number of standard methods, including, for example, heating the material in a vacuum furnace or protective atmosphere furnace, induction heating, and laser or arc lamp heating, among others. In one exemplary embodiment, the composite overlay compound formed through the brazing process has a microstructure of hard-particles uniformly dispersed in the relatively soft matrix, which is fused with a metallurgical bond to the substrate material. The thickness of the composite overlay compound may be any desired thickness, but in one exemplary embodiment is between 0.025 mm and 4 mm.

In addition to the prefabricated cloth method, the brazing process may include a high energy beam assisted overlaying process. In some exemplary embodiments, the high energy beam assisted overlaying process may include thermal spray and arc lamp processing, laser assisted thermal spray processing, and laser cladding, among other processes.

Example 5

In one exemplary embodiment of the invention, M4 tool steel powder was mixed with ferromolybdenum powder, ferroboron powder, and chrome powder at various ratios. In one exemplary embodiment, the ratios may be 40 wt %, 28 wt %, and 32 wt %, respectively. The mixture was thermally sprayed onto a substrate steel bushing, forming an overlay compound having a thickness of about 1 mm. Then, a high intensity arc lamp was used to density the overlay compound and fuse the composite overlay compound to the substrate with a metallurgical bond. Molybdenum iron complex boride was synthesized and precipitated during the process. When the brazing process was used on the bushing 136, the bushing showed a six-fold improvement over carburized bushings in wear resistance in lab bench tests.

After brazing, post-cladding heat treatment (such as martempering, direct hardening, or induction hardening) of the composite material may optionally be used to restore the microstructure and mechanical properties of the substrate material tempered by the relative high brazing temperature, which may be in the range between 950 and 1300 degrees Celsius. In one exemplary embodiment, when the substrate is the bushing 136, the interior surface 146 of the bushing 136 may be cooled by water, oil, or other media during the induction brazing process. This may reduce any need for a post-cladding heat treatment. It should be noted that when the substrate is the track bushing 136, the overlay compound may be applied to less than the 360 degree circumference of the exterior surface 144. In one example, the overlay compound is applied to about 180 degrees of the circumference of the of the exterior surface 144 of the bushing 136.

INDUSTRIAL APPLICABILITY

The wear-resistant material and processes described herein may provide increased wear resistance in friction and abrasive environments and may also provide increased impact resistance. The wear-resistant materials may be used to form, for example, undercarriage components, as well as linkage pins and joints for severe abrasive wear and corrosion applications, such as the exterior surface 144 of the bushing 136, a track roller, a rail, the sprocket 110, links, a track shoe grouser, a track shoe plate, and track links.

In addition, the wear-resistant material may be used to form ground engaging tools such as, for example, wear plates and various linkage pins, such, as a pivot pin, a radiator guard pin, an E-bar pin, among others. Further, the wear-resistant material may be used to form work tools, including work tool tips, such as, for example, a bucket tip and a blade edge. In general, the composite material may be used in any high load and impact application and may provide increased wear resistance, good overlay toughness, and/or good substrate material adhesion. This may increase the useful life of these components.

The bushing 136 formed of the composite material described herein may provide advantages over prior bushings used on endless track machines. For example, the useful life of the bushing 136 may be longer than the life of previous bushings because the exterior surface 144 may have improved resistance to abrasive wear and/or corrosive wear. In addition, the composite overlay compound may show an increased resistance to pitting, spalling, and/or flaking, even with typically applied stresses. Increasing the life of the bushing 136 may prolong the life of a track using the bushing 136, thereby reducing downtime and increasing work efficiency.

It will be apparent to those skilled in the art that various modifications and variations can be made in the disclosed embodiments without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A composite overlay compound and substrate, including:

a steel matrix with steel extending substantially throughout the matrix, the matrix including at least one component from a first group of component materials including titanium, chrome, and molybdenum, the matrix also including at least one component from a second group of component materials including silicon, nickel, and manganese;

hard-particles distributed substantially uniformly in the matrix, the hard-particles including at least one of carbide and boride synthesized during formation of the matrix, the matrix and the hard-particles cooperatively defining the composite overlay compound, wherein the composition of the composite overlay compound includes 5 to 50 wt % of the first group of component materials and 0.2 to 20 wt % of the second group of component materials; and a substrate disposed below the composite overlay compound, the matrix being fused to the substrate material with a metallurgical bond.

2. The composite overlay compound and substrate of claim 1, wherein the matrix and hard particles include an overall composition range of Ti: 0-40 wt %; Cr: 0-50 wt %; Mo: 0-50 wt %; Ni: 0-10 wt %; Si: 0-10 wt %; C: 0-10 wt %; Mn: 0-8 wt %; and B: 0-10 wt %, with a substantial portion the balance being iron.

3. The composite overlay compound and substrate of claim 2, wherein the matrix also includes up to 10 wt % of vanadium, niobium, and tungsten.

4. The composite overlay compound and substrate of claim 1, wherein the composite overlay compound includes 5 to 50 wt % of at least one element from the group of titanium, chrome, molybdenum, and a combination thereof;

wherein the composite overlay compound includes 3 to 10 wt % of at least one element from a group of carbon, boron, and a combination thereof;

wherein the composite overlay compound includes 1 to 20 wt % of at least one element from a group of manganese, silicon, nickel, and combinations thereof; and wherein the composite overlay compound includes up to 10 wt % of at least one element from a group of vanadium, niobium, tungsten, and a combination thereof.

5. The composite overlay compound and substrate of claim 4, wherein iron forms a substantial portion of a balance of a weight percentage of the composite overlay compound.

6. The composite overlay compound and substrate of claim 1, wherein the matrix is a steel matrix of one of austenite, martensite, and ferrite.

7. The composite overlay compound and substrate of claim 1, wherein the substrate is a pin.

8. The composite overlay compound and substrate of claim 1, wherein the substrate is a wear plate.

9. The composite overlay compound and substrate of claim 1, wherein the substrate forms at least a portion of the exterior surface of a bushing.

10. The composite overlay compound and substrate of claim 1, wherein the substrate is included as at least one component in an undercarriage assembly.

11. The composite overlay compound and substrate of claim 10, wherein the at least one component is at least one of a track roller, a rail, a sprocket, a track shoe, a grouser, a plate, and a track link.

12. A composite overlay compound and substrate, including:

a steel matrix with steel extending substantially throughout the matrix, the matrix including titanium, the matrix also including at least one component from a secondary group of component materials including silicon, nickel, and manganese;

hard-particles distributed substantially uniformly in the matrix, the hard-particles including at least one of titanium carbide and titanium boride synthesized during formation of the matrix, the matrix and the hard-particles cooperatively defining the composite overlay compound, wherein the composition of the composite overlay compound includes 5 to 50 wt % of titanium and 0.2 to 20 wt % of the secondary group of component materials; and a substrate disposed below the composite overlay compound, the matrix being fused to the substrate material with a metallurgical bond.

13. The composite overlay compound and substrate of claim 12, wherein the composite overlay compound includes 5 to 50 wt % of at least one element from the group of titanium, chrome, molybdenum, and a combination thereof;

wherein the composite overlay compound includes 3 to 10 wt % of at least one element from a group of carbon, boron, and a combination thereof;

wherein the composite overlay compound includes 1 to 20 wt % of at least one element from a group of manganese, silicon, nickel, and combinations thereof; and wherein the composite overlay compound includes up to 10 wt % of at least one element from a group of vanadium, niobium, tungsten, and a combination thereof.

14. The composite overlay compound and substrate of claim 13, wherein iron forms a substantial portion of a balance of a weight percentage of the composite overlay compound.

* * * * *